US006020859A

United States Patent [19]

Kildal

[11] Patent Number: 6,020,859

[45] Date of Patent: Feb. 1, 2000

[54] REFLECTOR ANTENNA WITH A SELF-SUPPORTED FEED

[76] Inventor: Per-Simon Kildal, Kullar 8, 43543 Molnlycke, Sweden

[21] Appl. No.: 08/718,989

[22] Filed: Sep. 26, 1996

[51] Int. Cl.[7] ..... H01Q 19/19

[52] U.S. Cl. ..... 343/781 CA; 343/840; 343/781 P

[58] Field of Search ..... 343/840, 781 P, 343/786, 781 CA, 781 R, 782, 837, 753; H01Q 19/19

[56] References Cited

U.S. PATENT DOCUMENTS 3,162,858 12/1964 Cutler ..... 343/753

4,963,878 10/1990 Kildal ..... 343/840

5,451,972 9/1995 Franklin ..... 343/872

*Primary Examiner*—Hoanganh Le

*Attorney, Agent, or Firm*—Pittenger & Smith, P.C.

[57] ABSTRACT

The present invention provides a reflector antenna which has dual polarization with low cross polarization within the main lobe and side lobes of the radiation pattern. The antenna includes a dish-shaped main reflector with a center located, self-supporting tubular feed element and a sub-reflector mounted on the free end of the tube and located at the focal area of the main reflector. The tube and sub-reflector are separated by a space which can be open or filled with a dielectric material. The diameter of the sub-reflector is greater than the tube. The surface of the sub-reflector facing the main reflector includes one or more concentric circular corrugations which can be filled with a dielectric material.

14 Claims, 2 Drawing Sheets

REFLECTOR ANTENNA WITH A SELF-SUPPORTED FEED

FIELD OF THE INVENTION

The invention consists of a reflector antenna with a self-supported feed for the transmission or reception of polarized electromagnetic waves. The antenna is principally intended for the use as a radio link between base stations for mobile communications, but also in other applications.

BACKGROUND OF THE INVENTION

These types of reflector antennas are chiefly used because they are straightforward and inexpensive to manufacture. They also provide greater antenna efficiency and lower side lobes in the radiation pattern than is the case when the feed has to be supported by diagonal struts. The drawback with the latter configuration is that the main reflector becomes blocked.

A self-supported feed is also easily accessible from the back of the reflector, thus is frequently selected when it is best to locate the transmitter and/or the receiver there. This also reduces the loss that occurs when the RF energy has to be routed through a cable along one of the support struts.

A. Chlavin, "A New Antenna Feed Having Equal E and H-Plane Patterns", IRE Trans. Antennas Propagat., Vol.AP-2, pp.113–119, July 1954, describes a reflector antenna with a self-supporting feed. However since this antenna uses a waveguide with a rectangular cross-section, it can only transmit or receive waves with one particular linear polarization.

C. C-Cutler, "Parabolic-antenna design for microwaves", Proc.IRE.Vil.35, pp. 1284–1294, November 1947, describes a dual polarized reflector antenna with two variants of a self-supporting feed, called the "ring focus waveguidecup" feeds, respectively. A circular waveguide is used in these two feeds with a reflecting object in front of the waveguide opening. This reflector is respectively shaped as a flat disc and a cup. Both of these prior art feeds produce high cross polarization within the main lobe of the radiation pattern, and high sidelobes and spillover contrary to the arrangement provided in the present invention.

The main purpose of the present invention is to design a reflector antenna which has dual polarization with low cross polarization within the main lobe of the radiation pattern and low sidelobes. Dual polarization means that the antenna is capable of receiving or transmitting simultaneously two separate RF signals with orthogonal, linear or circular polarization. To enable this, the waveguide must have an almost circular or square cross-section.

This present objective can be achieved by a design which is in accordance with the claim 1 of this application. Further details about the invention are given in claims 2–8 of this application.

SUMMARY OF THE INVENTION

The surface of the sub-reflector is provided with corrugations so that the electromagnetic waves are prohibited from propagating along the surface independent of whether the electric field is normal to the surface or is tangential to it. Furthermore, the design of the other geometries of the feed ensures that the cross-polarization remains low within the main lobe of the radiation pattern.

It should be mentioned that a dual polarized reflector antenna with a self-supporting feed is already known from among other sources, such as P. Newham, "The Search for an Efficient Splashplate Feed", Proceedings of the Third International Conference on Antennas and Propagation (ICAP 83), IEE Conference Publication No.219, pp. 348–352, April 1983, and in previous publications by the same author. In this design the sub-reflector has a smooth surface. Thereby, it is not possible to obtain low sidelobes in the E-plane.

In U.S. Pat. No. 3,162,858 a dual polarized reflector antenna is described with a self-supporting feed element which mainly consists of a radial waveguide shaped as two plane surfaces or two coaxial conical surfaces with a common apex. In the present invention there are no such radial waveguides, a sub-reflector is employed instead. Since the tube in the present invention is cylindrical rather than conical, the sub-reflector and the outside of the tube are unable to form radial waveguides. Consequently, the waves are not propagated in the form of radial wave modes in this area, as is the case in the U.S. Patent mentioned above.

In the U.S. Patent both walls in the radial waveguide have circular corrugations which are approximately 0.25 wavelengths deep. These corrugations result in the radial waves being propagated so that they are independent of the polarization in the waveguide. In the invention, it is only the sub-reflector which is supplied with corrugations. This consequently makes the invention cheaper to manufacture than the existing antenna where two surfaces have to be corrugated.

In U.S. Pat. No. 4,963,878 of Oct. 16, 1990, a similar dual polarized reflector antenna is described. The present invention is a further development of the antenna described in U.S. Pat. No. 4,963,878. In the latest years, computer memory and speed have developed so much that numerical optimization of the geometry of such antennas is possible by using computer codes based on e.g. the moment method. Thus, it is no longer necessary to limit the shape of the sub reflector to a planar surface, as used in U.S. Pat. No. 4,963,878 or a conical surface, as used in U.S. Pat. No. 3,162,858. The results of the optimization is improved side lobes and improved impedance matching. Also, there is no reason to limit the dielectric joint, which is located between the sub reflector and the end of the tube, to have a cylindrical outer surface of almost the same diameter as the tube.

All mechanical dimensions between the middle of the sub-reflector and the end of the tube are critical, nevertheless there are a good number of dimension combinations which provide satisfactory results.

BRIEF DESCRIPTION OF THE DRAWINGS

The invention will be explained in more detail by making reference to the drawings, where.

DETAILED DESCRIPTION OF THE INVENTION

Figure 1A:
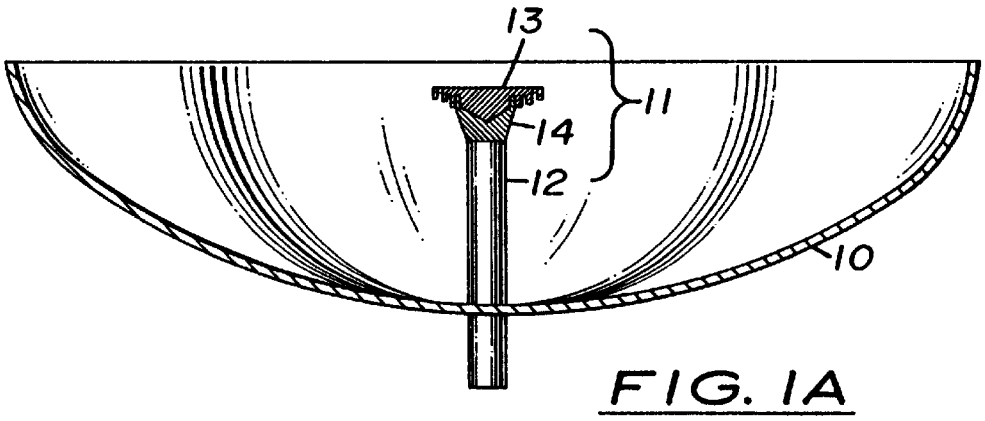
FIGS. 1*a*, 1*b* and 1*c* show axial cross sections of three examples of reflector antennas with self-supporting feeds.
Figure 1B:
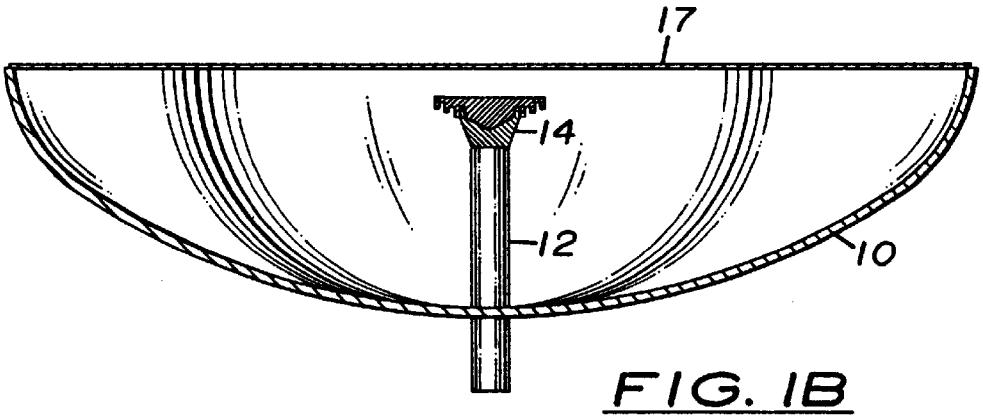
Figure 1C:
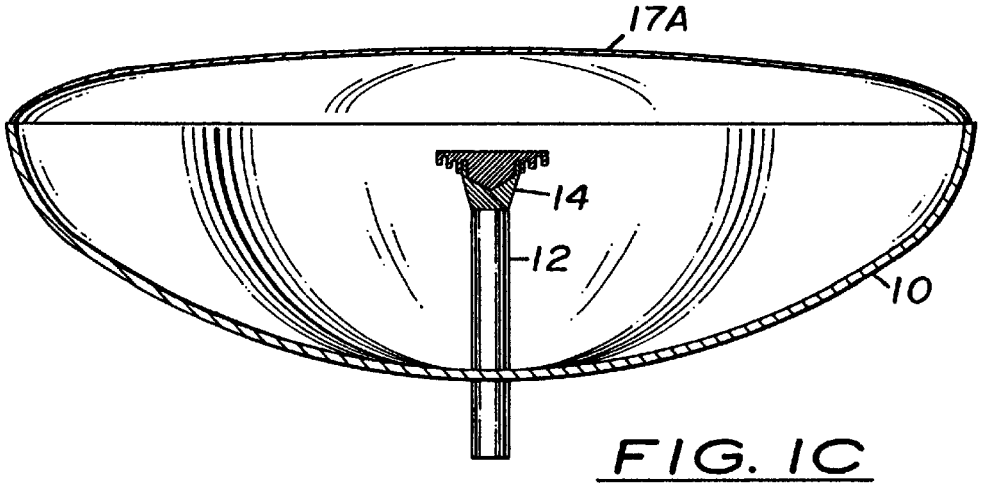

The antennas in FIGS. 1*a*–1*c* consist of a dish-shaped main reflector 10. In the middle of this there is a self-supporting tubular feed element 11. This consists of a cylindrical tube 12, and a sub-reflector 13. The tube and the sub-reflector are separated by a space 14 which is partly filled with a dielectric material. In the intermediate antenna there is a thin dielectric sheet 17 in front of the main reflector, and in the lower antenna there is a curved dielectric radome 17*a* in front of the main reflector.

Figure 2A:
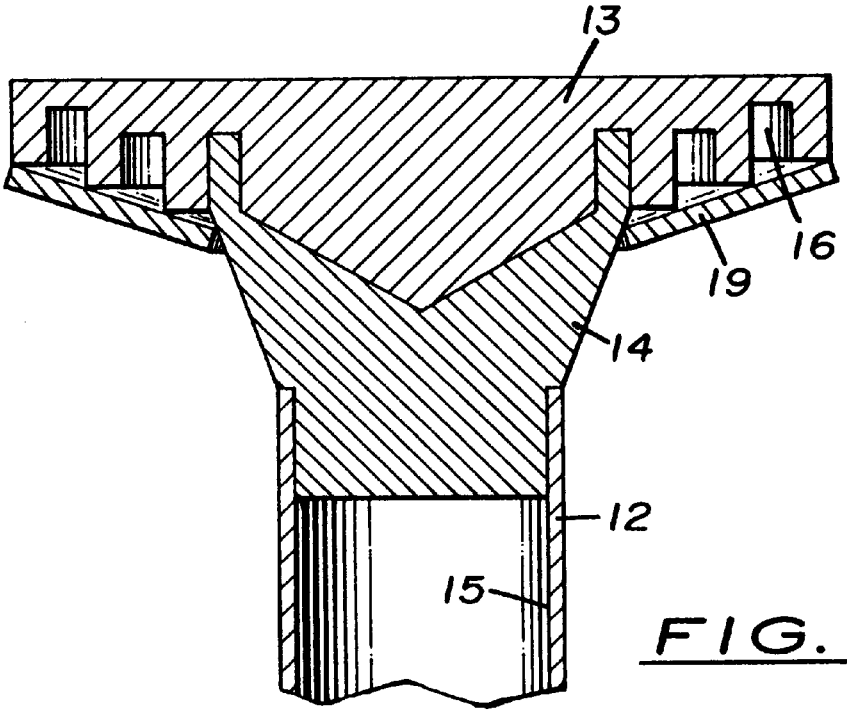
FIGS. 2*a* and 2*b* show axial cross-sections through two feeds designed in accordance with the invention.
Figure 2B:
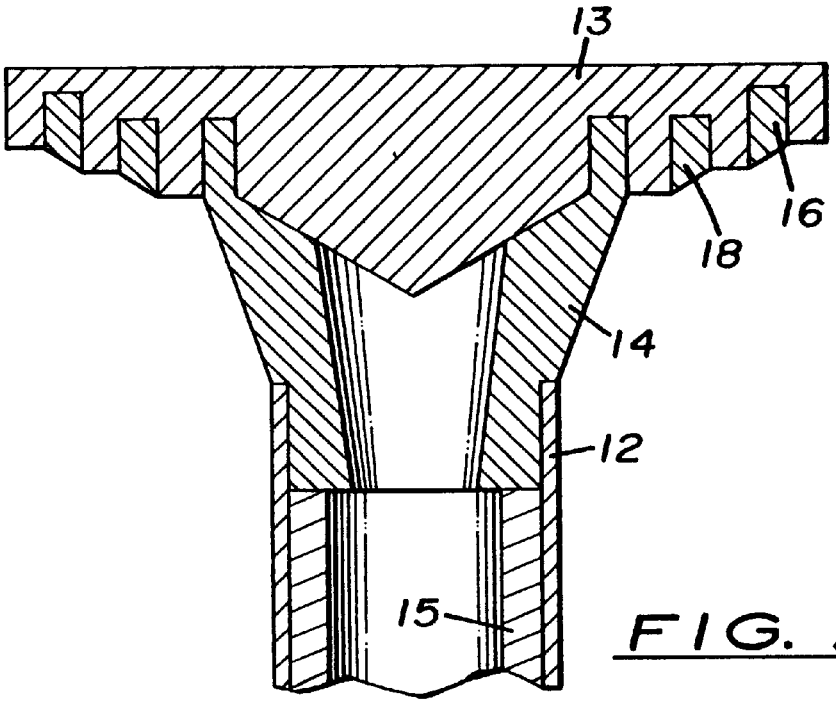

FIGS. 2*a*–2*b* show axial sections through two examples of the feed. In FIG. 2*a* the inner surface of the tube 12 forms a cylindrical waveguide 15 and in FIG. 2*b* there is a circular waveguide 15 located inside the tube 12. The waveguide has preferably a circular cross-section. The waveguide is designed to propagate the basic mode. This is the TE11 mode when the internal cross-section is circular with smooth conducting walls. The waveguide must have a larger diameter than 0.6 (approx.) wavelengths and be smaller than 1.2 (approx.). The tube and the waveguide are mostly made of conducting materials.

The surface of the sub-reflector has at least one circular corrugation 16 in it. The corrugation(s) are filled with dielectric material 18, but alternatively can be covered by dielectric material 19. These air- or dielectric-filled corrugations ensure that the electromagnetic waves are prohibited from propagating along the surface, regardless of whether the electric fields are normal to the surface or are tangential to it. This is important in order to achieve low side lobes. The diameter of the sub-reflector is always larger than the diameter of the tube. There is a gap 14 between the sub-reflector and the end of the waveguide. The gap in the upper figure is totally filled with dielectric matter, and in the lower figure is only partly filled. This total or partial filling is necessary to attach the sub-reflector to the tube. This is also a means of controlling the radiation characteristics and impedance match of the sub-reflector.

The resulting radiation pattern from the feed antenna has low cross-polarization and low side lobes. Unfortunately, there are considerable phase errors because the fields radiate around a tube. These phase errors can be compensated for by shaping the main reflector 10 differently from a parabolic surface. If the diameter of the tube 12 is about 1 mm, the optimal reflector shape will deviate by up to 1.6 mm from the best fitted parabola. The resultant radiation characteristics of the whole antenna are excellent and have low cross-polarization and low side lobes.

FIGS. 1*a*–1*c* and 2*a*–2*b* show a few different designs of the antenna. It should nevertheless be apparent from the claims that there are numerous other forms of designs possible. Common for all is that the sub-reflector has one or more corrugations.

What is claimed is:

1. In an antenna system, a reflector in a feed element for radiating and intercepting electromagnetic waves, comprising:

a) a main reflector; and b) a self-supported waveguide feed element located along the axis which passes through the center of said main reflector, said feed element including;

1) a support-tube which has a first, inner end attached to the center of said main reflector and a second, outer end located near the focal region of the reflector;

2) a waveguide in said tube;

3) a sub-reflector located outside said second, outer end of said tube and said waveguide, said sub-reflector having a diameter larger than said second, outer end of said support-tube;

4) a gap provided between said sub-reflector and said second, outer end of said tube;

5) said sub-reflector consisting of reflective material with a plurality of rotationally symmetric grooves; and 6) said plurality of grooves of said sub-reflector which are located outside a diameter equal to the diameter of said support-tube being filled with a dielectric material.

2. The reflector antenna system as claimed in claim 1, wherein said main reflector is rotationally symmetrical and has a substantial parabolic shape.

3. The reflector antenna system claimed in claim 1, wherein the gap between said tube and said sub-reflector is totally filled with a dielectric element which is interlocked with said waveguide and said sub-reflector.

4. The reflector antenna system claimed in claim 1, wherein the gap between said tube and said sub-reflector is partially filled with a dielectric element which is interlocked with said waveguide and said sub-reflector.

5. The reflector antenna system claimed in claim 1 wherein the waveguide is formed by the inner surface of said support tube.

6. The reflector antenna system claimed in claim 1, wherein the dielectric material totally encloses the feed element.

7. The reflector antenna system claimed in claim 1, wherein the dielectric material partly encloses the feed element.

8. In an antenna system, a reflector in a feed element for radiating and intercepting electromagnetic waves, comprising:

a) a main reflector; and b) a self-supported waveguide feed element located along the axis which passes through the center of said main reflector, said feed element including;

1) a support-tube which has a first, inner end attached to the center of said main reflector and a second, outer end located near the focal region of the reflector;

2) a waveguide in said tube;

3) a sub-reflector located outside said second, outer end of said tube and said waveguide, said sub-reflector having a diameter larger than said second, outer end of said support-tube;

4) a gap provided between said sub-reflector and said second, outer end of said tube;

5) said sub-reflector consisting of reflective material with a plurality of rotationally symmetric grooves; and 6) said plurality of grooves of said sub-reflector which are located outside a diameter equal to the diameter of said support-tube being covered with a dielectric material which is directly touching the grooves.

9. A reflector antenna system as claimed in claim 8, wherein said main reflector is rotationally symmetrical and has a substantial parabolic shape.

10. A reflector antenna system claimed in claim 8, wherein the gap between said tube and said sub-reflector is totally filled with the dielectric element which is interlocked with said waveguide and said sub-reflector.

11. The reflector antenna system claimed in claim 8, wherein the gap between said tube and said sub-reflector is partially filled with a dielectric element which is interlocked with said waveguide and said sub-reflector.

12. The reflector antenna system claimed in claim 8, wherein the waveguide is formed by the inner surface of said support-tube.

13. The reflector antenna system claimed in claim 8, wherein the dielectric material totally encloses the feed element.

14. The reflector antenna system claimed in claim 8, wherein the dielectric material partly encloses the feed element.

* * * * *

UNITED STATES PATENT AND TRADEMARK OFFICE

CERTIFICATE OF CORRECTION

PATENT NO. : 6,020,859

DATED : February 1, 2000

INVENTOR(S) : Per-Simon Kildal

It is certified that error appears in the above-indentified patent and that said Letters Patent is hereby corrected as shown below:

Column 1, line 25, change ""ring focus and the waveguide cup"" to --"ring focus" and "waveguide cup"--.

Column 3, line 33, change "1 mm" to --1 wavelength--; and
line 34, change "1.6 mm" to --0.16 wavelength--.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*